US008035580B2

(12) United States Patent
Chung et al.

(10) Patent No.: US 8,035,580 B2
(45) Date of Patent: Oct. 11, 2011

(54) ELECTRO-LUMINESCENCE DISPLAY PANEL AND DRIVING METHOD THEREOF

(75) Inventors: Hoon Ju Chung, Pyeongtaek-si (KR); Chang Hoon Jeon, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 1087 days.

(21) Appl. No.: 11/094,186

(22) Filed: Mar. 31, 2005

(65) Prior Publication Data

US 2005/0219169 A1 Oct. 6, 2005

(30) Foreign Application Priority Data

Mar. 31, 2004 (KR) ..... 10-2004-0022122

(51) Int. Cl.
*G09G 3/30* (2006.01)

(52) U.S. Cl. ..... 345/76; 345/77

(58) Field of Classification Search ..... 345/45, 345/76, 77, 78, 79, 80, 81, 36
See application file for complete search history.

(56) References Cited

U.S. PATENT DOCUMENTS

2003/0057895 A1* 3/2003 Kimura ..... 315/370
2003/0103022 A1* 6/2003 Noguchi et al. ..... 345/77
2003/0214245 A1* 11/2003 Yamazaki et al. ..... 315/169.3
2004/0075627 A1* 4/2004 Ouchi et al. ..... 345/76

* cited by examiner

*Primary Examiner* — Yong H Sim
(74) *Attorney, Agent, or Firm* — McKenna Long & Aldridge LLP

(57) ABSTRACT

An electro-luminescence display panel and a driving method thereof for preventing a life shortening of the EL caused by a direct current are disclosed. In the electro-luminescence display panel implementing a gray level by a combination of light-emitting periods of sub-frames corresponding to each bit of video data, each of pixels includes an electro-luminescence (EL) cell, and a cell driver for allowing a forward current to be flown into the EL cell in accordance with a supplied data signal in a light-emitting period of the sub-frame while allowing a backward bias to be applied to the EL cell in a non-light-emitting period of the sub-frame.

11 Claims, 7 Drawing Sheets

ELECTRO-LUMINESCENCE DISPLAY PANEL AND DRIVING METHOD THEREOF

This application claims the benefit of Korean Patent Application No. P2004-22122 filed in Korea on Mar. 31, 2004, which is hereby incorporated by reference.

BACKGROUND OF THE INVENTION

1. Field of the Invention

This invention relates to an electro-luminescence display (EL) display panel, and more particularly to an EL display panel and a driving method thereof that are adaptive for preventing a life shortening of the EL caused by a direct current (DC).

2. Description of the Related Art

Recently, there have been highlighted various flat panel display devices reduced in weight and bulk that is capable of eliminating disadvantages of a cathode ray tube (CRT). Such flat panel display devices include a liquid crystal display (LCD), a field emission display (FED), a plasma display panel (PDP) and an electro-luminescence (EL) display panel, etc.

The EL display panel of such display devices is a self-luminous device capable of light-emitting a phosphorous material by a re-combination of electrons with holes. The EL display device is generally classified into an inorganic EL device using an inorganic compound as the phosphorous material and an organic EL device using an organic compound as it. Such an EL display panel can be driven a low driving voltage (e.g., 10V) unlike other display devices, and has an excellent recognition because it employs a self-luminescence. Also, the EL display panel can implement an ultra thin film device because it does not need a back light unlike the LCD. Furthermore, the EL display panel has advantages of a wider viewing angle and a faster response speed in comparison to the LCD such that it can be highlighted into a post-generation display device.

The organic EL device is usually comprised of an electron injection layer, an electron carrier layer, a light-emitting layer, a hole carrier layer and a hole injection layer that are disposed between a cathode and an anode. In such an organic EL device, when a predetermined voltage is applied between the anode and the cathode, electrons produced from the cathode are moved, via the electron injection layer and the electron carrier layer, into the light-emitting layer while holes produced from the anode are moved, via the hole injection layer and the hole carrier layer, into the light-emitting layer. Thus, the electrons and the holes fed from the electron carrier layer and the hole carrier layer emit a light by their re-combination at the light-emitting layer.

An active matrix EL display panel employing such an organic EL device is largely classified into an analog driving method and a digital driving method.

The analog driving method of the EL display panel is a driving method that controls a current amount fed to an EL cell by an analog signal having a different level in accordance with a video data signal, that is, by a voltage or current, thereby controlling brightness.

On the other hand, the digital driving method of the EL display panel is a driving method that controls a light-emitting time of the EL cell according to a digital video data signal, thereby controlling brightness. In this case, in order to control a light emitting period of the EL cell, one frame is divided into 1st to 6th sub-frames SF1 to SF6 when it is intended to a plurality of sub-frames corresponding to each bit of video data, that is, 6-bit video data as shown in FIG. 1.

Further, since different weighting values are given to light-emitting periods of the 1st to 6th sub-frames SF1 to SF6, a ratio LT1:LT2:LT3:LT4:LT5:LT6 of the light-emitting periods of the 1st to 6th sub-frames SF1 to SF6 becomes 1:2:4:8:16:32. The 1st to 4th sub-frames SF1 to SF4 other than the 5th and 6th sub-frames SF5 and SF6 includes non-light-emitting periods UT1, UT2, UT3 and UT4 that are gradually decreased in opposition to the light-emitting periods LT1, LT2, LT3 and LT4. The EL cells arranged in a matrix type at the EL display panel are scanned, on a line sequence basis, in each light-emitting period LT1 to LT6 of the 1st to 6th sub-frames SF1 to SF6 to be turned on in accordance with a data signal, thereby providing a light-emission. On the other hand, the EL cells are scanned, on a line sequence basis, in each non-light-emitting period UT1 to UT4 of the 1st to 4th sub-frames SF1 to SF4 to be turned off, thereby stopping a light-emission. Accordingly, brightness of the EL device is implemented by combining light-emitting times of the sub-frames turned on in accordance with video data.

FIG. 2 is a detailed circuit diagram of one pixel configuring an active matrix EL display panel for providing a digital driving. FIG. 3 is a driving timing diagram of the first sub-frame SF1.

The pixel shown in FIG. 2 is comprised of an EL cell OLED, and a cell driver including three PMOS transistors P1, P2 and P3 and a storage capacitor Cs for driving the EL cell OLED.

The cell driver includes a storage capacitor Cs connected to a power line PL, a first switching PMOS transistor P1 connected between a data line DL and the storage capacitor Cs to be controlled by a light-emitting scan line SLp, a second switching PMOS transistor P2 connected between the power line PL and the storage capacitor Cs to be controlled by a non-light-emitting scan line SLe, and a third driving PMOS transistor P3 connected between a voltage supply line VDD and the EL cell OLED to be controlled by the storage capacitor Cs.

A writing scan line SLp provides a writing signal, that is, a program signal PS for turning on the first PMOS transistor P1 in a light-emitting period LT of each sub-frame SF. The first PMOS transistor P1 is turned on by the program signal PS to charge a data signal into the storage capacitor Cs, thereby turning on or off the third PMOS transistor P3 in accordance with the charged voltage during the light-emitting period LT.

An erasing scan line SLe provides an erasing signal ES for turning on the second PMOS transistor P2 in a non-light-emitting period UT of each sub-frame SF. The second PMOS transistor P2 is turned on by the erasing signal SE to discharge the storage capacitor Cs, thereby turning on the third PMOS transistor P3 during the non-light-emitting period UT.

Referring to FIG. 3, the first PMOS transistor P1 is turned on by a low voltage of the program signal PS in the non-light-emitting period LT1 of the 1st sub-frame SF1. Further, a low voltage ("0") or a high voltage ("1") of the data signal is supplied via the turned-on first PMOS transistor P1 to be charged in the storage capacitor Cs. When the low voltage is charged in the storage capacitor Cs, the third PMOS transistor P3 is turned on to thereby turn on, that is, light-emit the EL cell OLED during the light-emitting period LT. On the other hand, when the high voltage is charged in the storage capacitor Cs, the third PMOS transistor P3 does not turn off, that is, light-emit the EL cell OLED during the light-emitting period LT.

Then, the second PMOS transistor P2 is turned on by a low voltage of the erasing signal SE in the non-light-emitting period UT1 to supply a high-level voltage VDD from the power line PL to a gate electrode of the third PMOS transistor P3, thereby discharging the storage capacitor Cs. Thus, the third PMOS transistor P3 is turned off, thereby allowing the EL cell OLED to be turned off, that is, to provide a non-light-emission in the non-light-emitting period UT.

However, the related art EL display panel has a problem in that, since it allows a current to be flown only in a forward direction (i.e., anode→cathode) at the EL cell for the purpose of light-emitting the EL cell OLED, a life of the EL cell OLED is shortened due to a direct current (DC).

Furthermore, the EL display panel driven by the digital driving method as shown in FIG. 2 also has a problem in that, since it allows a forward direction current to be flown into the EL cell OLED in accordance with a data signal in the light-emitting period LT while allowing a current to be not flown into the EL cell OLED by floating the anode of the EL cell OLED in the non-light-emitting period UT, a life of the EL cell OLED is shortened due to a direct current (DC).

SUMMARY OF THE INVENTION

Accordingly, it is an object of the present invention to provide an EL display panel and a driving method thereof wherein a backward bias can be applied to an EL cell in a non-light-emitting period of each sub-frame, thereby preventing a life shortening of the EL device caused by a direct current.

In order to achieve these and other objects of the invention, an electro-luminescence display panel according to one aspect of the present invention implements a gray level by a combination of light-emitting periods of sub-frames corresponding to each bit of video data, wherein each of pixels includes an electro-luminescence (EL) cell; and a cell driver for allowing a forward current to be flown into the EL cell in accordance with a supplied data signal in a light-emitting period of the sub-frame while allowing a backward bias to be applied to the EL cell in a non-light-emitting period of the sub-frame.

In the electro-luminescence display panel, the cell driver includes a storage capacitor having one electrode connected to a power line; a first switching transistor connected between a data line for supplying said data signal and other electrode of the storage capacitor to be controlled by a writing scan line for supplying a writing signal; a second switching transistor connected to the power line and other electrode of the storage capacitor to be controlled by an erasing scan line for supplying an erasing signal; a driving transistor connected between the power line and the EL cell to be controlled by the storage capacitor; and a backward bias transistor connected between the driving transistor and a backward bias voltage input line to be controlled by the storage capacitor in opposition to the driving transistor.

Herein, the first switching transistor is turned on by said writing signal in the light-emitting period to charge said data signal into the capacitor, and the second switching transistor is turned on by said erasing signal in the non-light-emitting period to discharge said data signal charged in the capacitor.

The driving transistor turned on or off in accordance with said voltage charged in the capacitor in the light-emitting period while being turned off by said discharge of the capacitor in the non-light-emitting period, and allows said forward current to be flown into the EL cell when it is turned on in the light-emitting period.

The backward bias transistor is turned on in opposition to the driving transistor in the non-light-emitting period, thereby applying said backward bias to the EL cell.

Further, the backward bias transistor is turned on when the driving transistor is turned off by said data signal charged in the capacitor in the light-emitting period, thereby applying said backward bias to the EL cell.

The backward bias input line is identical to the erasing scan line.

The erasing scan line applies a turn-on voltage of the second switching transistor as said erasing signal in the non-light-emitting period, and said backward bias is applied, via the backward bias transistor, to the EL cell during a period when said turn-on voltage of said erasing signal is applied.

The first and second switching transistors and the driving transistor are PMOS transistors, and the backward bias transistor is a NMOS transistor.

A method of driving an electro-luminescence display panel according to another aspect of the present invention implementing a gray level by a combination of light-emitting periods of sub-frames corresponding to each bit of video data includes the steps of allowing a forward current to be flown into an electro-luminescence (EL) cell in accordance with a data signal in a light-emitting period of the sub-frame; and allowing a backward bias to be applied to the EL cell in a non-light-emitting period of the sub-frame.

In the method, said light-emitting period includes allowing said backward bias to applied to the EL cell when a non-light-emitting data signal for non-light-emitting the EL cell by said data signal is supplied.

Herein, said light-emitting period includes allowing said data signal to be charged, via the first switching transistor, to a capacitor by a writing scan signal from a writing scan line; and turning on a driving transistor in accordance with a voltage charged in the capacitor, thereby allowing said forward current to be flown into the EL cell.

Said non-light-emitting period includes discharging the capacitor through a second switching transistor by an erasing scan signal from an erasing scan line; and turning off the driving transistor while turning on a backward bias transistor by a discharge of the capacitor, thereby applying said backward bias to the EL cell.

Herein, said light-emitting period includes turning off the driving transistor while turning on the backward bias transistor when said data signal is a non-light-emitting data, thereby applying said backward bias to the EL cell.

The backward bias transistor applies any one of said backward bias voltage and said erasing signal to the EL cell in the non-light-emitting period.

Herein, when the backward bias transistor supplies said erasing signal in the non-light-emitting period, said backward bias is applied to the EL cell only in a period when a turn-on voltage for turning on the second driving transistor by said erasing signal is supplied.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 4 to 7.

Figure 1:
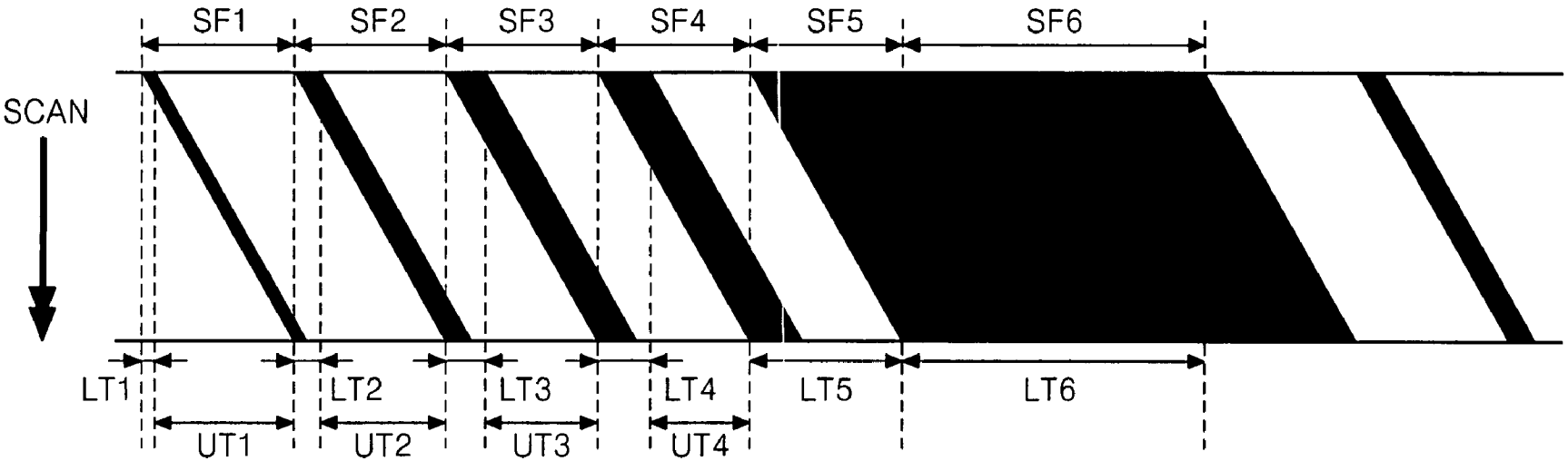
FIG. 1 RELATED ART
FIG. 1 is a driving timing diagram of one frame according to a digital driving method of a general EL display panel.
Figure 2:
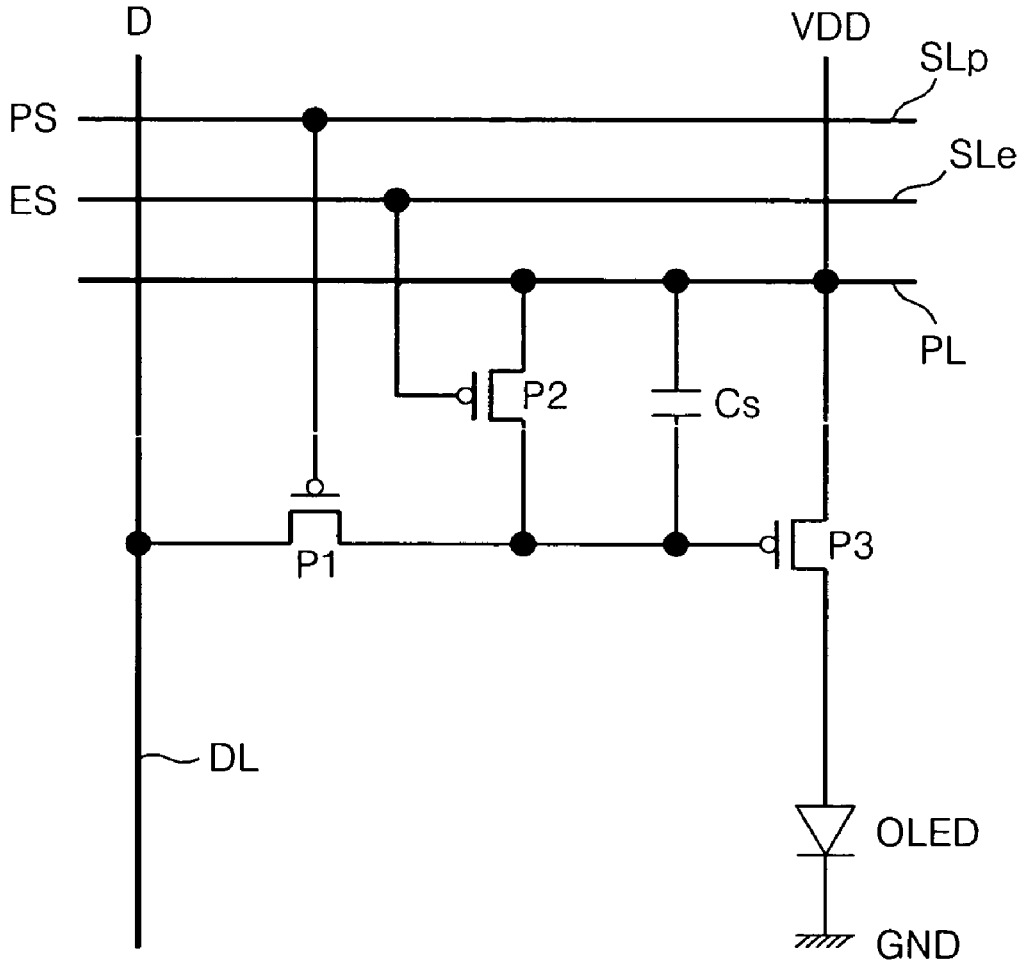
FIG. 2 RELATED ART
FIG. 2 is a detailed circuit diagram of one pixel configuring the related art EL display panel.
Figure 3:
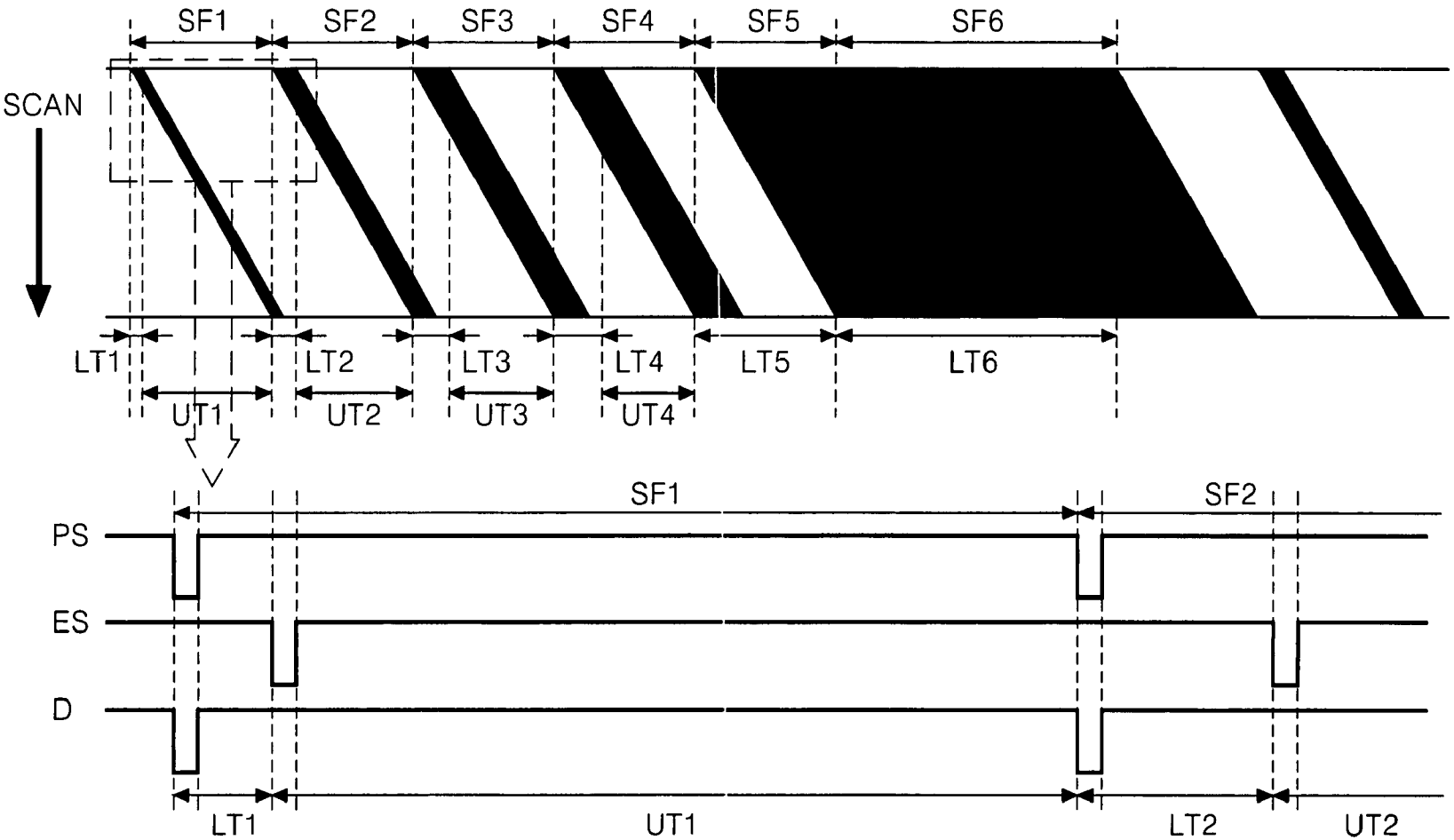
FIG. 3 RELATED ART
FIG. 3 is a digital driving timing diagram of the EL display panel shown in FIG. 2.
Figure 4:
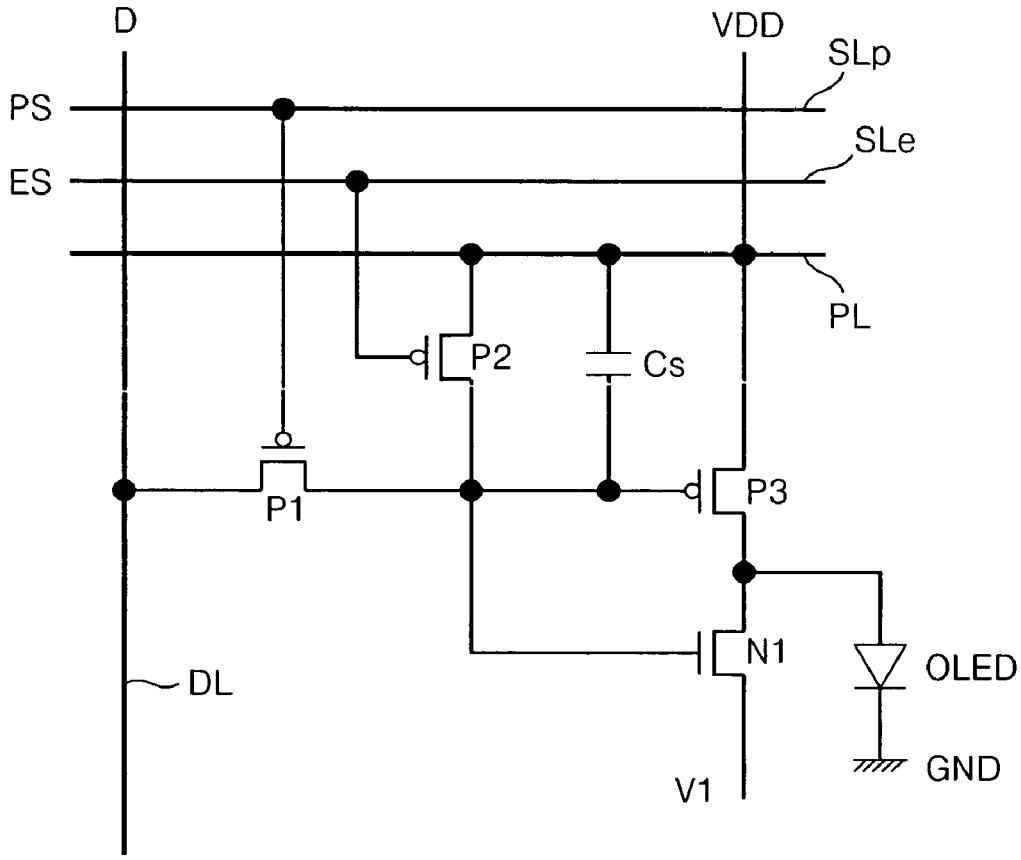
FIG. 4 is a detailed circuit diagram of one pixel of an EL display panel according to an embodiment of the present invention.
Figure 5:
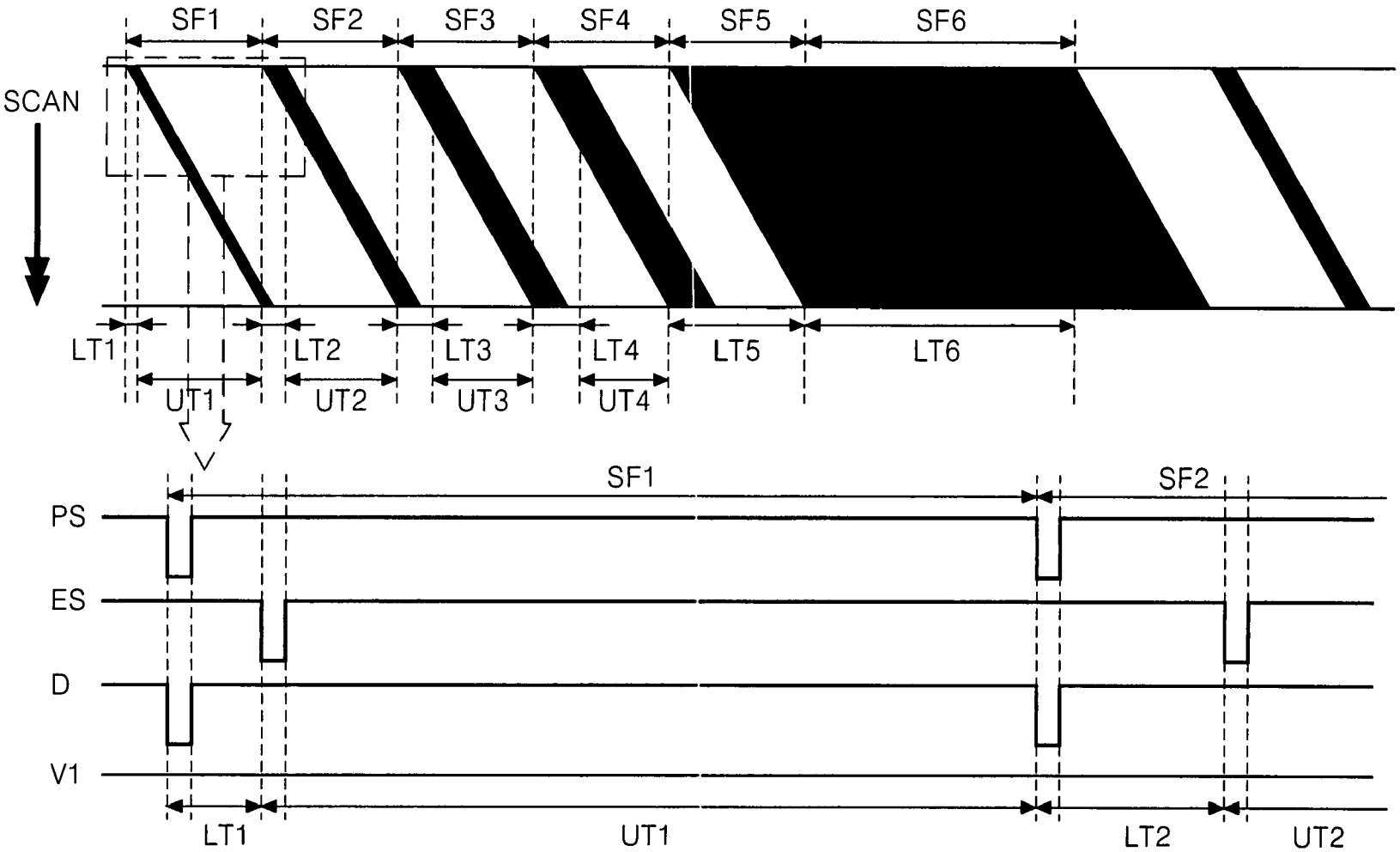
FIG. 5 is a digital driving timing diagram of the EL display panel shown in FIG. 4.

FIG. 4 is a detailed circuit diagram of one pixel of an active matrix EL display panel for a digital driving according to an embodiment of the present invention, and FIG. 5 is a driving timing diagram of the 1st sub-frame SF1 of a plurality of sub-frames SF1 to SF6.

Referring to FIG. 4, the pixel is comprised of an EL cell OLED, and a cell driver including three PMOS transistors P1, P2 and P3, a single of NMOS transistor N1 and a storage capacitor Cs for driving the EL cell OLED.

The cell driver includes a storage capacitor Cs connected to a power line PL, a first switching PMOS transistor P1 connected between a data line DL and the storage capacitor Cs to be controlled by a light-emitting scan line SLp, a second switching PMOS transistor P2 connected between the power line PL and the storage capacitor Cs to be controlled by a non-light-emitting scan line SLe, a third driving PMOS transistor P3 connected between a voltage supply line VDD and the EL cell OLED to be controlled by the storage capacitor Cs, and a first NMOS transistor N1 connected between the storage capacitor and a backward bias voltage (V1) input line to be controlled by the storage capacitor Cs.

A writing scan line SLp provides a program signal PS for turning on the first PMOS transistor P1 in a light-emitting period LT of each sub-frame SF The first PMOS transistor P1 is turned on by the program signal PS to charge the storage capacitor Cs, thereby turning on or off the third PMOS transistor P3 in accordance with the charged voltage during the light-emitting period LT; whereas the first NMOS transistor N1 is operated to the contrary. Thus, when the third PMOS transistor P3 is turned on in the light-emitting period LT, a high-level voltage VDD is supplied to the EL cell OLED such that a forward current is flown into the EL cell OLED, thereby light-emitting the EL cell OLED. On the other hand, when the first NMOS transistor N1 is turned on in the light-emitting period LT, a backward bias voltage V1 is supplied to the EL cell OLED to apply a backward bias to the EL cell OLED, thereby providing an aging of the EL cell OLED An erasing scan line SLe provides an erasing signal ES for turning on the second PMOS transistor P2 in a non-light-emitting period UT of each sub-frame SF, and the backward bias voltage (V1) input line supplies a direct current backward bias voltage V1 remaining at a low-level voltage as shown in FIG. 5. The second PMOS transistor P2 is turned on by the erasing signal SE to discharge the storage capacitor Cs, thereby turning on the third PMOS transistor P3 during the non-light-emitting period UT. On the other hand, the first NMOS transistor N1 is turned on to apply a backward bias to the EL cell OLED, thereby providing an aging of the EL cell OLED.

Referring to FIG. 5, the first PMOS transistor P1 is turned on by a low voltage of the program signal PS in the non-light-emitting period LT1 of the 1st sub-frame SF1. Further, a low voltage ("0") or a high voltage ("1") of the data signal is supplied via the turned-on first PMOS transistor P1, so that the data signal is charged in the storage capacitor Cs. When the low voltage of the data signal is charged in the storage capacitor Cs, the third PMOS transistor P3 is turned on during the light-emitting period LT such that a forward current is flown into the EL cell OLED, thereby light-emitting the EL cell OLED. On the other hand, when the high voltage of the data signal is charged in the storage capacitor Cs, the third PMOS transistor P3 is turned off while the first NMOS transistor N1 being turned on during the light-emitting period LT such that a backward bias is applied to the EL cell OLED, thereby providing an aging of the EL cell OLED.

Then, the second PMOS transistor P2 is turned on by a low voltage of the erasing signal SE in the non-light-emitting period UT1 to supply a high-level voltage VDD from the power line PL, thereby discharging the storage capacitor Cs. Thus, the third PMOS transistor P3 is turned off while the first NMOS transistor N1 being turned on during the non-light-emitting period UT1 such that a backward bias is applied to the EL cell OLED, thereby providing an aging of the EL cell OLED.

As described above, the EL display panel according to the embodiment of the present invention applies a forward current when the EL cell OLED is light-emitted while applying a backward bias when the EL cell OLED is not light-emitted, so that it can prevent a life shortening of the EL cell OLED.

Figure 6:
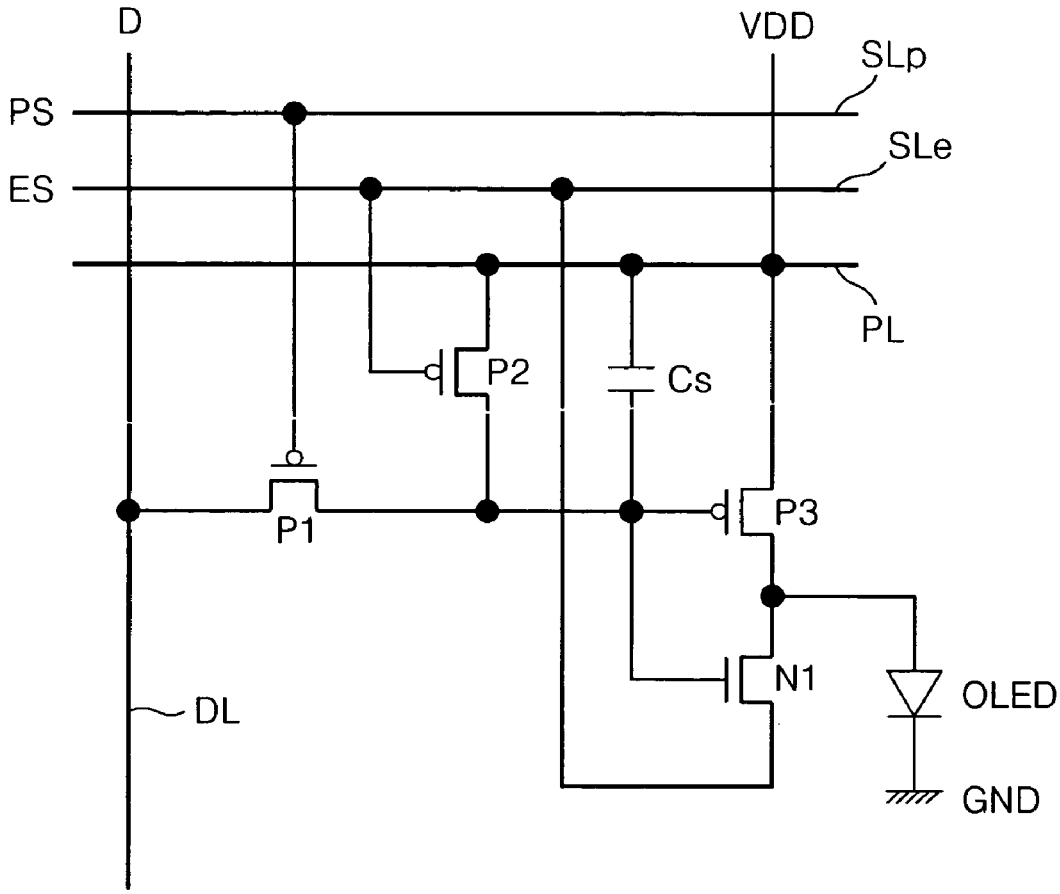
FIG. 6 is a detailed circuit diagram of one pixel of an EL display panel according to another embodiment of the present invention.
Figure 7:
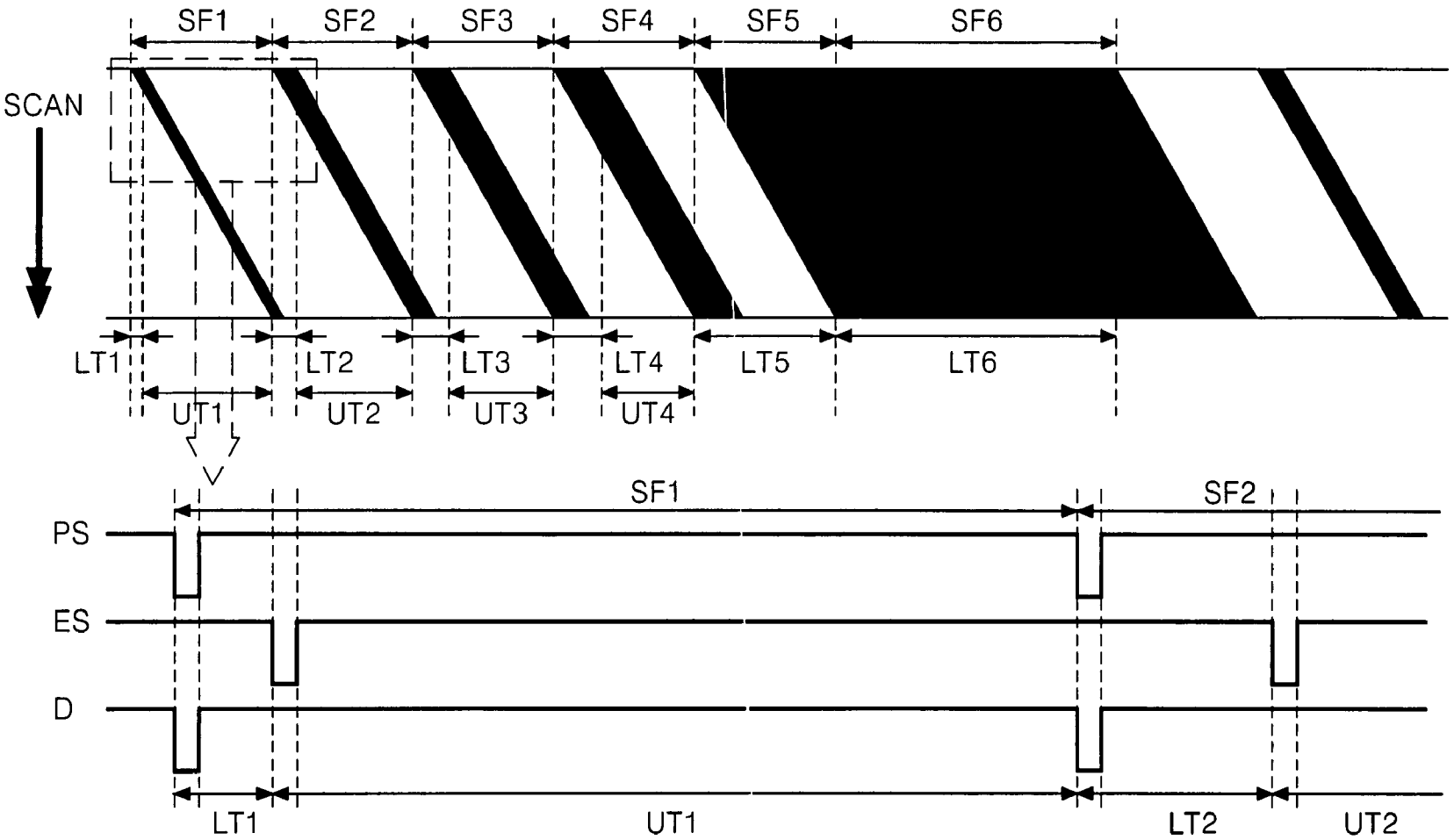
FIG. 7 is a digital driving timing diagram of the EL display panel shown in FIG. 6.

FIG. 6 is a detailed circuit diagram of one pixel in an EL display panel according to another embodiment of the present invention, and FIG. 7 is a driving timing diagram.

The pixel shown in FIG. 6 includes the same elements as the pixel shown in FIG. 4 except that the first NMOS transistor N1 for applying a backward bias employs an erasing signal ES as a backward bias voltage. Thus, a detailed explanation as to the same elements will be omitted.

The first NMOS transistor N1 shown in FIG. 6 is connected between the third PMOS transistor P3 and the erasing scan line SLe to be controlled by the storage capacitor Cs. If the second PMOS transistor P2 is turned on by a low voltage of the erasing signal ES in the non-light-emitting period UT1 as shown in FIG. 7, the first NMOS transistor N1 is turned on in opposition to the third PMOS transistor P3 due to a discharge of the storage capacitor Cs. The turned-on first NMOS transistor N1 supplies a low voltage of the erasing signal ES from the erasing scan line SLe to the EL cell OLED such that a backward current is flown into the EL cell OLED, thereby providing an aging of the EL cell OLED. Herein, the first NMOS transistor N1 allows a backward bias to be applied to the EL cell OLED only in a period when the low voltage of the erasing signal ES is supplied to the erasing scan line SLe.

For instance, when the erasing signal ES remains at a low voltage during the non-light-emitting period UT1 as shown in FIG. 7, the first NMOS transistor N1 allows a backward bias to be applied to the EL cell OLED during the non-light-emitting period UT1. On the other hand, when the erasing signal ES remains at a low voltage only in a portion of the non-light-emitting period UT1 as shown in FIG. 5, the first NMOS transistor N1 allows a backward bias to be applied to the EL cell OLED only in the low voltage period.

As described above, according to the present invention, a forward current is applied when the EL cell is light-emitted while a backward bias being applied when the EL cell is not light-emitted in the digital driving method, so that it becomes possible to prevent a life shortening of the EL cell caused by a direct current.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electro-luminescence display panel implementing a gray level by a combination of light-emitting periods of sub-frames corresponding to each bit of video data, wherein each pixel comprises:

an electro-luminescence (EL) cell; and a cell driver for allowing a forward current to flow into the EL cell in accordance with a supplied data signal in a light-emitting period of a sub-frame while allowing a backward bias voltage to be applied to the EL cell in a non-light-emitting period of the sub-frame, wherein the cell driver comprises, a storage capacitor having a first electrode connected to a power line, a first switching transistor connected between a data line supplying the data signal and a second electrode of the storage capacitor to be controlled by a writing scan line supplying a writing signal, a second switching transistor connected to the power line and the second electrode of the storage capacitor to be controlled by an erasing scan line supplying an erasing signal, the erasing signal varies between a high and low voltage, wherein the erasing signal allows a backward bias voltage to be applied to the El cell when the erasing signal is at a low voltage, a driving transistor connected between the power line and the EL cell to be controlled by the storage capacitor, and a backward bias transistor connected between the driving transistor and the erasing scan line, wherein the second electrode of the storage capacitor is directly connected to a gate of the backward bias transistor and a gate of the driving transistor to drive the storage capacitor in opposition to the driving transistor.

2. The electro-luminescence display panel according to claim 1, wherein the first switching transistor is turned on by the writing signal in the light-emitting period to charge the data signal into the capacitor, and the second switching transistor is turned on by the erasing signal in the non-light-emitting period to discharge the data signal charged in the capacitor.

3. The electro-luminescence display panel according to claim 1, wherein the first and second switching transistors and the driving transistor are PMOS transistors, and the backward bias transistor is a NMOS transistor.

4. The electro-luminescence display panel according to claim 1, wherein the backward bias transistor is directly electrically connected between the driving transistor and the erasing scan line.

5. The electro-luminescence display panel according to claim 2, wherein the driving transistor is turned on or off in accordance with the voltage charged in the capacitor in the light-emitting period while being turned off by the discharge of the capacitor in the non-light-emitting period, and allows the forward current to flow into the EL cell when the driving transistor is turned on in the light-emitting period.

6. The electro-luminescence display panel according to claim 2, wherein the backward bias transistor is turned on in opposition to the driving transistor in the non-light-emitting period, thereby applying the backward bias voltage to the EL cell.

7. The electro-luminescence display panel according to claim 2, wherein the backward bias input line is identical to the erasing scan line.

8. The electro-luminescence display panel according to claim 6, wherein the backward bias transistor is turned on when the driving transistor is turned off by the data signal charged in the capacitor in the light-emitting period, thereby applying the backward bias voltage to the EL cell.

9. The electro-luminescence display panel according to claim 7, wherein the erasing scan line applies a turn-on voltage of the second switching transistor as the erasing signal in the non-light-emitting period, and the backward bias voltage is applied, via the backward bias transistor, to the EL cell during a period when the turn-on voltage of the erasing signal is applied.

10. A method of driving an electro-luminescence display panel implementing a gray level by a combination of light-emitting periods of sub-frames corresponding to each bit of video data, the method comprising the steps of:

allowing a forward current to flow into an electro-luminescence (EL) cell in accordance with a data signal in a light-emitting period of a sub-frame; and allowing a backward bias voltage to be applied to the EL cell in a non-light-emitting period of the sub-frame, wherein the light-emitting period includes:

allowing the backward bias voltage to be applied to the EL cell when a non-light-emitting data signal for non-light-emitting the EL cell by the data signal is supplied, allowing the data signal to be charged, via the first switching transistor, to a capacitor by a writing scan signal from a writing scan line; and turning on a driving transistor in accordance with a voltage charged in the capacitor, thereby allowing the forward current to flow into the EL cell, and the non-light-emitting period includes:

discharging the capacitor through a second switching transistor by an erasing scan signal from an erasing scan line wherein the erasing scan signal varies between a high and low voltage, wherein the erasing signal allows a backward bias voltage to be applied to the El cell when the erasing signal is at a low voltage;

turning off the driving transistor while turning on a backward bias transistor of which a gate electrode is directly connected to the capacitor by a discharge of the capacitor, thereby applying the backward bias voltage to the EL cell; and turning off the driving transistor while turning on the backward bias transistor when the data signal is a non-light-emitting data, thereby applying the backward bias voltage to the EL cell, wherein the backward bias transistor applies the erasing signal to the EL cell in the non-light-emitting period.

11. The method according to claim 10, wherein, when the backward bias transistor supplies the erasing signal in the non-light-emitting period, the backward bias voltage is applied to the EL cell only in a period when a turn-on voltage for turning on the second driving transistor by the erasing signal is supplied.

* * * * *